US011276371B2

(12) United States Patent
Peana et al.

(10) Patent No.: US 11,276,371 B2
(45) Date of Patent: Mar. 15, 2022

(54) SYSTEMS AND METHODS FOR IDENTIFYING AND CORRECTING ILLUMINATION SOURCES REFLECTING ON DISPLAYS

(71) Applicant: Dell Products, L.P., Round Rock, TX (US)

(72) Inventors: Stefan Peana, Austin, TX (US); Karun Palicherla Reddy, Austin, TX (US); John Trevor Morrison, Round Rock, TX (US)

(73) Assignee: Dell Products, L.P., Round Rock, TX (US)

( * ) Notice: Subject to any disclaimer, the term of this patent is extended or adjusted under 35 U.S.C. 154(b) by 0 days.

(21) Appl. No.: 16/985,019

(22) Filed: Aug. 4, 2020

(65) Prior Publication Data

US 2022/0044653 A1 Feb. 10, 2022

(51) Int. Cl.
*G09G 5/10* (2006.01)
*G09G 3/3225* (2016.01)

(52) U.S. Cl.
CPC ..... *G09G 5/10* (2013.01); *G09G 3/3225* (2013.01); *G09G 2320/0646* (2013.01); *G09G 2354/00* (2013.01); *G09G 2360/141* (2013.01); *G09G 2360/144* (2013.01)

(58) Field of Classification Search
None
See application file for complete search history.

(56) References Cited

U.S. PATENT DOCUMENTS

| | | | | |
|---|---|---|---|---|
| 9,911,395 | B1 * | 3/2018 | Townsend | G06F 1/1686 |
| 9,965,999 | B1 * | 5/2018 | Barnes | G09G 3/3413 |
| 2015/0070337 | A1 * | 3/2015 | Bell | G09G 3/007 345/207 |
| 2015/0287389 | A1 * | 10/2015 | Mese | G09G 5/10 345/207 |
| 2017/0053604 | A1 * | 2/2017 | Li | H05B 47/11 |
| 2018/0129262 | A1 * | 5/2018 | Veiga | G06F 1/1681 |
| 2018/0151154 | A1 * | 5/2018 | Lee | G02B 5/22 |
| 2018/0182357 | A1 * | 6/2018 | Yun | G09G 5/02 |
| 2019/0213309 | A1 * | 7/2019 | Morestin | G01S 7/4865 |
| 2019/0278368 | A1 * | 9/2019 | Werner | G09G 5/02 |
| 2021/0104208 | A1 * | 4/2021 | Goodsitt | G09G 5/10 |

* cited by examiner

*Primary Examiner* — Amr A Awad
*Assistant Examiner* — Donna V Bocar
(74) *Attorney, Agent, or Firm* — Fogarty LLP

(57) ABSTRACT

Systems and methods for identifying and correcting illumination sources are described. In some embodiments, an Information Handling System (IHS) may include a processor and a memory coupled to the processor, the memory having program instructions stored thereon that, upon execution, cause the IHS to: receive a measurement from an Ambient Light Sensor (ALS); determine that the measurement indicates an increase in ambient illumination equal to or greater than a threshold value; in response to the determination, receive an image from a charge-coupled device (CCD) sensor; extract illumination data from the image; and adjust the measurement in response to the illumination data.

18 Claims, 6 Drawing Sheets

SYSTEMS AND METHODS FOR IDENTIFYING AND CORRECTING ILLUMINATION SOURCES REFLECTING ON DISPLAYS

FIELD

The present disclosure relates generally to Information Handling Systems (IHSs), and more particularly, to systems and methods for identifying and correcting illumination sources.

BACKGROUND

As the value and use of information continue to increase, individuals and businesses seek additional ways to process and store it. One option available to users is Information Handling Systems (IHSs). An IHS generally processes, compiles, stores, and/or communicates information or data for business, personal, or other purposes thereby allowing users to take advantage of the value of the information. Because technology and information handling needs and requirements vary between different users or applications, IHSs may also vary regarding what information is handled, how the information is handled, how much information is processed, stored, or communicated, and how quickly and efficiently the information may be processed, stored, or communicated.

Variations in IHSs allow for IHSs to be general or configured for a specific user or specific use such as financial transaction processing, airline reservations, enterprise data storage, or global communications. In addition, IHSs may include a variety of hardware and software components that may be configured to process, store, and communicate information and may include one or more computer systems, data storage systems, and networking systems.

Users typically interface with an IHS using an electronic screen, display, or monitor. Unfortunately, most IHSs can be negatively impacted by light incident onto the screen from nearby light sources. Conventional approaches for mitigating display surface reflectivity may include the use of anti-refection (AR) technologies, anti-glare (AG) technologies, or some combination of the two. Portable IHSs (e.g., tablets, laptops, etc.) currently employ the AR approach which can be generally effective in reducing diffuse reflection while maintaining image quality ("diffuse reflection" is the reflection of light from a surface such that a ray incident on the surface is scattered at many angles, rather than at just one angle, as in the case of "specular reflection").

As the inventors hereof have determined, however, office environments present a special challenge to conventional AR mitigation, in part, because light sources typically found in those environments tend to be concentrated such that the resulting specular reflection is several orders of magnitude greater than diffuse reflection. To address these, and other issues, the inventors hereof have developed systems and methods for identifying and correcting illumination sources.

SUMMARY

Embodiments of systems and methods for identifying and correcting illumination sources are described. In an illustrative, non-limiting embodiment, an Information Handling System (IHS) may include a processor and a memory coupled to the processor, the memory having program instructions stored thereon that, upon execution, cause the IHS to: receive a measurement from an Ambient Light Sensor (ALS); determine that the measurement indicates an increase in ambient illumination equal to or greater than a threshold value; in response to the determination, receive an image from a charge-coupled device (CCD) sensor; extract illumination data from the image; and adjust the measurement in response to the illumination data.

The program instructions, upon execution, may cause the IHS to reduce the measurement using a look-up table (LUT). Additionally, or alternatively, the program instructions, upon execution by the processor, may cause the IHS to modify a brightness of a display coupled to the IHS based upon the adjusted measurement.

Additionally, or alternatively, the program instructions, upon execution, may cause the IHS to identify a light source in the image. To identify the light source, the program instructions, upon execution, may cause the IHS to determine a location, intensity, and shape of the light source. Additionally, or alternatively, the program instructions, upon execution, may cause the IHS to apply a blue light noise correction to the image based upon the identification of the light source prior to rendering the image on the display. Prior to receiving the measurement, the program instructions, upon execution, may cause the IHS to classify a location of the IHS as matching that of an office environment, and the measurement may be received in response to the classification.

In some cases, the threshold value may be selected based upon at least one of an identity of a user or a user's proximity to the IHS. Additionally, or alternatively, the threshold value may be selected based upon at least one of: an identity of an application currently under execution or a duration of execution of the application. Additionally, or alternatively, the threshold value may be selected based upon a user's gaze direction. Additionally, or alternatively, the threshold value may be selected based upon a current IHS posture. The current IHS posture may be determined by an angle of a hinge coupling two portions of the IHS.

In another illustrative non-limiting embodiment, a memory storage device having program instructions stored thereon that, upon execution by one or more processors of an IHS, cause the IHS to: receive a measurement from an ALS; determine that the measurement indicates an increase in ambient illumination equal to or greater than a threshold value; in response to the determination, receive an image from a CCD sensor; identify a light source in the image, the identification comprising a location, an intensity, and a shape of the light source; and apply a blue light noise correction to the image based upon the identification of the light source prior to rendering the image on the display.

In yet another illustrative, non-limiting embodiment, a method, may include receiving a measurement from an ALS; determining that the measurement indicates an increase in ambient illumination equal to or greater than a threshold value; in response to the determination, receiving an image from a CCD sensor; extracting illumination data from the image; adjusting the measurement in response to the illumination data; identifying a light source in the image, the identification comprising a location, an intensity, and a shape of the light source; applying a blue light noise correction to the image based upon the identification of the light source prior to rendering the image on the display; and modifying a brightness of a display coupled to the IHS based upon the adjusted measurement.

BRIEF DESCRIPTION OF THE DRAWINGS

The present invention(s) is/are illustrated by way of example and is/are not limited by the accompanying figures, in which like references indicate similar elements. Elements in the figures are illustrated for simplicity and clarity, and have not necessarily been drawn to scale.

DETAILED DESCRIPTION

Figure 1:
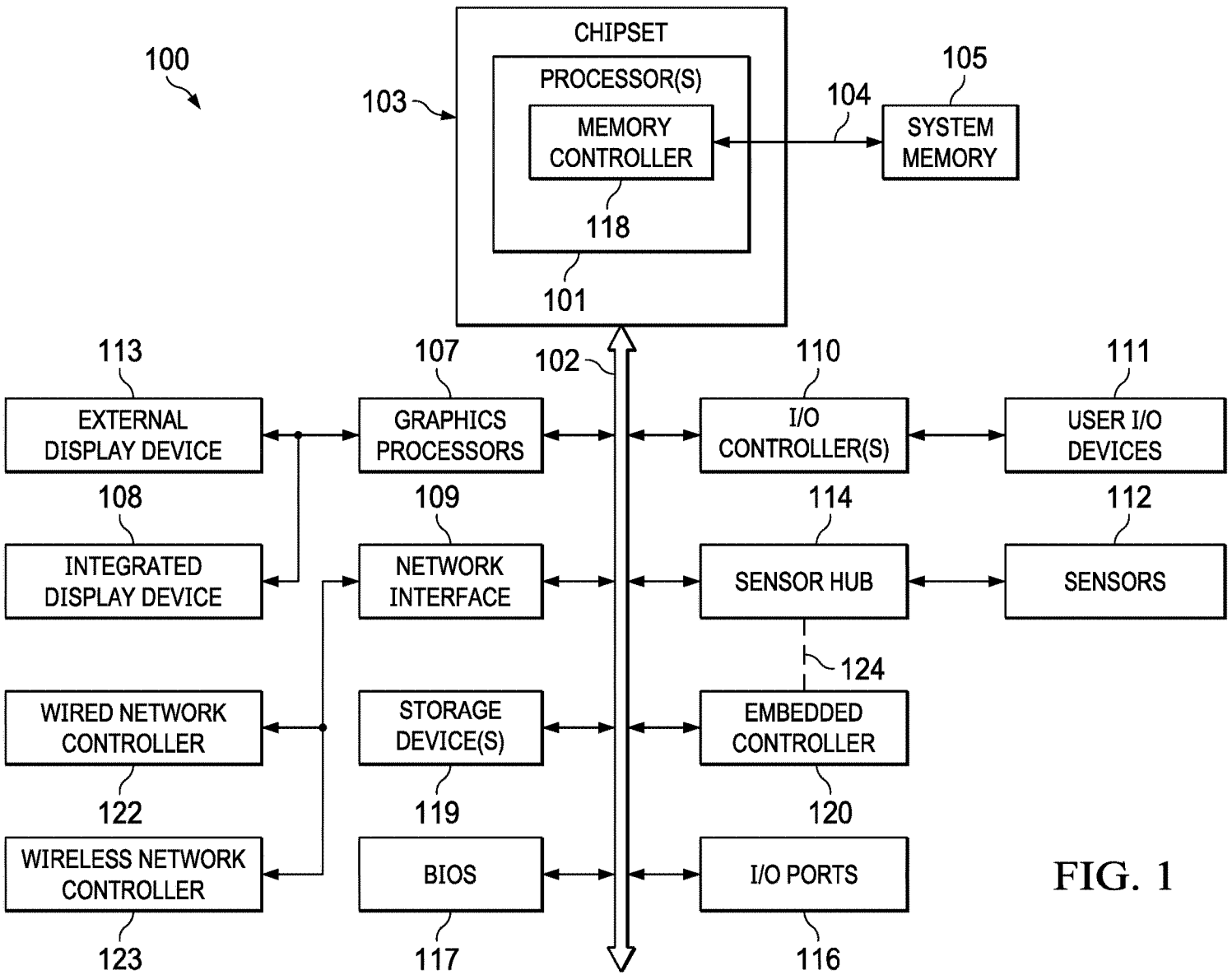
FIG. 1 is a diagram of an example of an Information Handling System (IHS) configured to perform identification and correction of illumination sources, according to some embodiments.

Systems and methods for identifying and correcting illumination sources are described. Generally speaking, an electronic display's image quality is a weighted combination of the visually significant attributes of all objects in a displayed image. Even when if the image quality of a display were otherwise perfect, however, that image quality can be disrupted by specular light sources reflected by the display's screen.

As used herein, the term "display" generally refers to an output device that displays information in pictorial form. For example, a display may include a liquid crystal display (LCD) with light-emitting diode (LED) backlighting, an organic light-emitting diode (OLED) display, a plasma display, etc.

In some embodiments, systems and methods described herein may (a) identify the location, intensity, and shape of a specular reflected light source, and (b) diminish them or reduce their impact relative to the display's overall image quality. For example, a charge-coupled device (CCD) image sensor may be employed to identify one or more light sources in each image. Once a light source's location, intensity, and shape is identified, then a post-processing image management method may be executed to reduce or eliminate the light sources from the image, and to color rebalance the image prior to sending it to the display for rendering to the user. In some cases, blue light noise processing may be used to diminish the specular reflection by blending the light source into the background.

In other embodiments, systems and methods described herein may modify an Ambient Light Sensor (ALS) sensor's measurement accuracy to help adjust the image brightness. Conventional ALS sensors tend to be point measurement sensors thus unable to identify whether its measurements are due to ambient illumination or to an emitting light source, and erroneous readings can lead to swings in the display's brightness settings that are disruptive to the user.

For purposes of this disclosure, an Information Handling System (IHS) may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an IHS may be a personal computer (e.g., desktop or laptop), tablet computer, mobile device (e.g., Personal Digital Assistant (PDA) or smart phone), server (e.g., blade server or rack server), a network storage device, or any other suitable device and may vary in size, shape, performance, functionality, and price. An IHS may include Random Access Memory (RAM), one or more processing resources such as a Central Processing Unit (CPU) or hardware or software control logic, Read-Only Memory (ROM), and/or other types of nonvolatile memory.

Additional components of an IHS may include one or more disk drives, one or more network ports for communicating with external devices as well as various I/O devices, such as a keyboard, a mouse, touchscreen, and/or a video display. An IHS may also include one or more buses operable to transmit communications between the various hardware components.

FIG. 1 is a block diagram illustrating components of IHS 100 configured to perform real-time monitoring and policy enforcement of active applications and services. As shown, IHS 100 includes one or more processors 101, such as a Central Processing Unit (CPU), that execute code retrieved from system memory 105. Although IHS 100 is illustrated with a single processor 101, other embodiments may include two or more processors, that may each be configured identically, or to provide specialized processing operations. Processor 101 may include any processor capable of executing program instructions, such as an Intel Pentium™ series processor or any general-purpose or embedded processors implementing any of a variety of Instruction Set Architectures (ISAs), such as the x86, POWERPC®, ARM®, SPARC®, or MIPS® ISAs, or any other suitable ISA.

In the embodiment of FIG. 1, processor 101 includes an integrated memory controller 118 that may be implemented directly within the circuitry of processor 101, or memory controller 118 may be a separate integrated circuit that is located on the same die as processor 101. Memory controller 118 may be configured to manage the transfer of data to and from the system memory 105 of IHS 100 via high-speed memory interface 104. System memory 105 that is coupled to processor 101 provides processor 101 with a high-speed memory that may be used in the execution of computer program instructions by processor 101.

Accordingly, system memory 105 may include memory components, such as static RAM (SRAM), dynamic RAM (DRAM), NAND Flash memory, suitable for supporting high-speed memory operations by the processor 101. In certain embodiments, system memory 105 may combine both persistent, non-volatile memory and volatile memory. In some implementations, system memory 105 may include multiple removable memory modules.

IHS 100 utilizes chipset 103 that may include one or more integrated circuits that are connect to processor 101. In the embodiment of FIG. 1, processor 101 is depicted as a component of chipset 103. In other embodiments, all of chipset 103, or portions of chipset 103 may be implemented directly within the integrated circuitry of processor 101. Chipset 103 provides processor 101 with access to a variety of resources accessible via bus 102. In IHS 100, bus 102 is illustrated as a single element. Various embodiments may utilize any number of separate buses to provide the illustrated pathways served by bus 102.

In various embodiments, IHS 100 may include one or more I/O ports 116 that may support removeable couplings with various types of external devices and systems, including removeable couplings with peripheral devices that may be configured for operation by a particular user of IHS 100.

For instance, I/O 116 ports may include USB (Universal Serial Bus) ports, by which a variety of external devices may be coupled to IHS 100. In addition to or instead of USB ports, I/O ports 116 may include various types of physical I/O ports that are accessible to a user via the enclosure of the IHS 100.

In certain embodiments, chipset 103 may additionally utilize one or more I/O controllers 110 that may each support the operation of hardware components such as user I/O devices 111 that may include peripheral components that are physically coupled to I/O port 116 and/or peripheral components that are wirelessly coupled to IHS 100 via network interface 109. In various implementations, I/O controller 110 may support the operation of one or more user I/O devices 110 such as a keyboard, mouse, touchpad, touchscreen, microphone, speakers, camera and other input and output devices that may be coupled to IHS 100. User I/O devices 111 may interface with an I/O controller 110 through wired or wireless couplings supported by IHS 100. In some cases, I/O controllers 110 may support configurable operation of supported peripheral devices, such as user I/O devices 111.

As illustrated, a variety of additional resources may be coupled to processor(s) 101 of IHS 100 through chipset 103. For instance, chipset 103 may be coupled to network interface 109 that may support different types of network connectivity. IHS 100 may also include one or more Network Interface Controllers (NICs) 122 and 123, each of which may implement the hardware required for communicating via a specific networking technology, such as Wi-Fi, BLUETOOTH, Ethernet and mobile cellular networks (e.g., CDMA, TDMA, LTE). Network interface 109 may support network connections by wired network controllers 122 and wireless network controllers 123. Each network controller 122 and 123 may be coupled via various buses to chipset 103 to support different types of network connectivity, such as the network connectivity utilized by IHS 100.

Chipset 103 may also provide access to one or more display device(s) 108 and/or 113 via graphics processor 107. Graphics processor 107 may be included within a video card, graphics card or within an embedded controller installed within IHS 100. Additionally, or alternatively, graphics processor 107 may be integrated within processor 101, such as a component of a system-on-chip (SoC). Graphics processor 107 may generate display information and provide the generated information to one or more display device(s) 108 and/or 113, coupled to IHS 100.

One or more display devices 108 and/or 113 coupled to IHS 100 may utilize LCD, LED, OLED, or other display technologies. Each display device 108 and 113 may be capable of receiving touch inputs such as via a touch controller that may be an embedded component of the display device 108 and/or 113 or graphics processor 107, or it may be a separate component of IHS 100 accessed via bus 102. In some cases, power to graphics processor 107, integrated display device 108 and/or external display 133 may be turned off or configured to operate at minimal power levels in response to IHS 100 entering a low-power state (e.g., standby).

As illustrated, IHS 100 may support integrated display device 108, such as a display integrated into a laptop, tablet, 2-in-1 convertible device, or mobile device. IHS 100 may also support use of one or more external displays 113, such as external monitors that may be coupled to IHS 100 via various types of couplings, such as by connecting a cable from the external display 113 to external I/O port 116 of the IHS 100. In certain scenarios, the operation of integrated displays 108 and external displays 113 may be configured for a particular user. For instance, a particular user may prefer specific brightness settings that may vary the display brightness based on time of day and ambient lighting conditions.

Chipset 103 also provides processor 101 with access to one or more storage devices 119. In various embodiments, storage device 119 may be integral to IHS 100 or may be external to IHS 100. In certain embodiments, storage device 119 may be accessed via a storage controller that may be an integrated component of the storage device. Storage device 119 may be implemented using any memory technology allowing IHS 100 to store and retrieve data. For instance, storage device 119 may be a magnetic hard disk storage drive or a solid-state storage drive. In certain embodiments, storage device 119 may be a system of storage devices, such as a cloud system or enterprise data management system that is accessible via network interface 109.

As illustrated, IHS 100 also includes Basic Input/Output System (BIOS) 117 that may be stored in a non-volatile memory accessible by chipset 103 via bus 102. Upon powering or restarting IHS 100, processor(s) 101 may utilize BIOS 117 instructions to initialize and test hardware components coupled to the IHS 100. BIOS 117 instructions may also load an operating system (OS) (e.g., WINDOWS, MACOS, iOS, ANDROID, LINUX, etc.) for use by IHS 100.

BIOS 117 provides an abstraction layer that allows the operating system to interface with the hardware components of the IHS 100. The Unified Extensible Firmware Interface (UEFI) was designed as a successor to BIOS. As a result, many modern IHSs utilize UEFI in addition to or instead of a BIOS. As used herein, BIOS is intended to also encompass UEFI.

Certain IHS 100 embodiments may utilize sensor hub 114 capable of sampling and/or collecting data from a variety of hardware sensors 112. For instance, sensors 112, may be disposed within IHS 100, and/or display 110, and/or a hinge coupling a display portion to a keyboard portion of IHS 100, and may include, but are not limited to: electric, magnetic, hall effect, radio, optical, infrared, thermal, force, pressure, touch, acoustic, ultrasonic, proximity, position, location, angle, deformation, bending, direction, movement, velocity, rotation, acceleration, bag state (in or out of a bag), and/or lid sensor(s) (open or closed).

In some cases, one or more sensors 112 may be part of a keyboard or other input device. Processor 101 may be configured to process information received from sensors 112 through sensor hub 114, and to perform methods for performing real-time monitoring and policy enforcement of active applications and services using contextual information obtained from sensors 112.

For instance, during operation of IHS 100, the user may open, close, flip, swivel, or rotate display 108 to produce different IHS postures. In some cases, processor 101 may be configured to determine a current posture of IHS 100 using sensors 112.

For example, in a dual-display IHS implementation, when a first display 108 (in a first IHS portion) is folded against a second display 108 (in a second IHS portion) so that the two displays have their backs against each other, IHS 100 may be said to have assumed a book posture. Other postures may include a table posture, a display posture, a laptop posture, a stand posture, or a tent posture, depending upon whether IHS 100 is stationary, moving, horizontal, resting at a different angle, and/or its orientation (landscape vs. portrait).

In a laptop posture, a first display surface of a first display 108 may be facing the user at an obtuse angle with respect to a second display surface of a second display 108 or a physical keyboard portion. In a tablet posture, a first display 108 may be at a straight angle with respect to a second display 108 or a physical keyboard portion. And, in a book posture, a first display 108 may have its back resting against the back of a second display 108 or a physical keyboard portion.

It should be noted that the aforementioned postures, and their various respective keyboard states, are described for sake of illustration. In different embodiments, other postures may be used, for example, depending upon the type of hinge coupling the displays, the number of displays used, or other accessories.

In other cases, processor 101 may process user presence data received by sensors 112 and may determine, for example, whether an IHS's end-user is present or absent. Moreover, in situations where the end-user is present before IHS 100, processor 101 may further determine a distance of the end-user from IHS 100 continuously or at pre-determined time intervals. The detected or calculated distances may be used by processor 101 to classify the user as being in the IHS's near-field (user's position<threshold distance A), mid-field (threshold distance A<user's position<threshold distance B, where B>A), or far-field (user's position>threshold distance C, where C>B) with respect to IHS 100 and/or display 108.

More generally, in various implementations, processor 101 may receive and/or to produce system context information using sensors 112 including one or more of, for example: a user's presence state (e.g., present, near-field, mid-field, far-field, absent), a facial expression of the user, a direction of the user's gaze, a user's gesture, a user's voice, an IHS location (e.g., based on the location of a wireless access point or Global Positioning System), IHS movement (e.g., from an accelerometer or gyroscopic sensor), lid state (e.g., of a laptop), hinge angle (e.g., in degrees), IHS posture (e.g., laptop, tablet, book, tent, and display), whether the IHS is coupled to a dock or docking station, a distance between the user and at least one of: the IHS, the keyboard, or a display coupled to the IHS, a type of keyboard (e.g., a physical keyboard integrated into IHS 100, a physical keyboard external to IHS 100, or an on-screen keyboard), whether the user operating the keyboard is typing with one or two hands (e.g., holding a stylus, or the like), a time of day, software application(s) under execution in focus for receiving keyboard input, whether IHS 100 is inside or outside of a carrying bag, ambient lighting, a battery charge level, whether IHS 100 is operating from battery power or is plugged into an AC power source (e.g., whether the IHS is operating in AC-only mode, DC-only mode, or AC+DC mode), a power consumption of various components of IHS 100 (e.g., CPU 101, GPU 107, system memory 105, etc.).

In certain embodiments, sensor hub 114 may be an independent microcontroller or other logic unit that is coupled to the motherboard of IHS 100. Sensor hub 114 may be a component of an integrated system-on-chip incorporated into processor 101, and it may communicate with chipset 103 via a bus connection such as an Inter-Integrated Circuit (VC) bus or other suitable type of bus connection. Sensor hub 114 may also utilize an FC bus for communicating with various sensors supported by IHS 100.

As illustrated, IHS 100 may utilize embedded controller (EC) 120, which may be a motherboard component of IHS 100 and may include one or more logic units. In certain embodiments, EC 120 may operate from a separate power plane from the main processors 101 and thus the OS operations of IHS 100. Firmware instructions utilized by EC 120 may be used to operate a secure execution system that may include operations for providing various core functions of IHS 100, such as power management, management of operating modes in which IHS 100 may be physically configured and support for certain integrated I/O functions. In some embodiments, EC 120 and sensor hub 114 may communicate via an out-of-band signaling pathway or bus 124.

In various embodiments, IHS 100 may not include each of the components shown in FIG. 1. Additionally, or alternatively, IHS 100 may include various additional components in addition to those that are shown in FIG. 1. Furthermore, some components that are represented as separate components in FIG. 1 may in certain embodiments be integrated with other components. For example, in some embodiments, all or a portion of the functionality provided by the illustrated components may instead be provided by components integrated into the one or more processor(s) 101 as an SoC.

Figure 2:
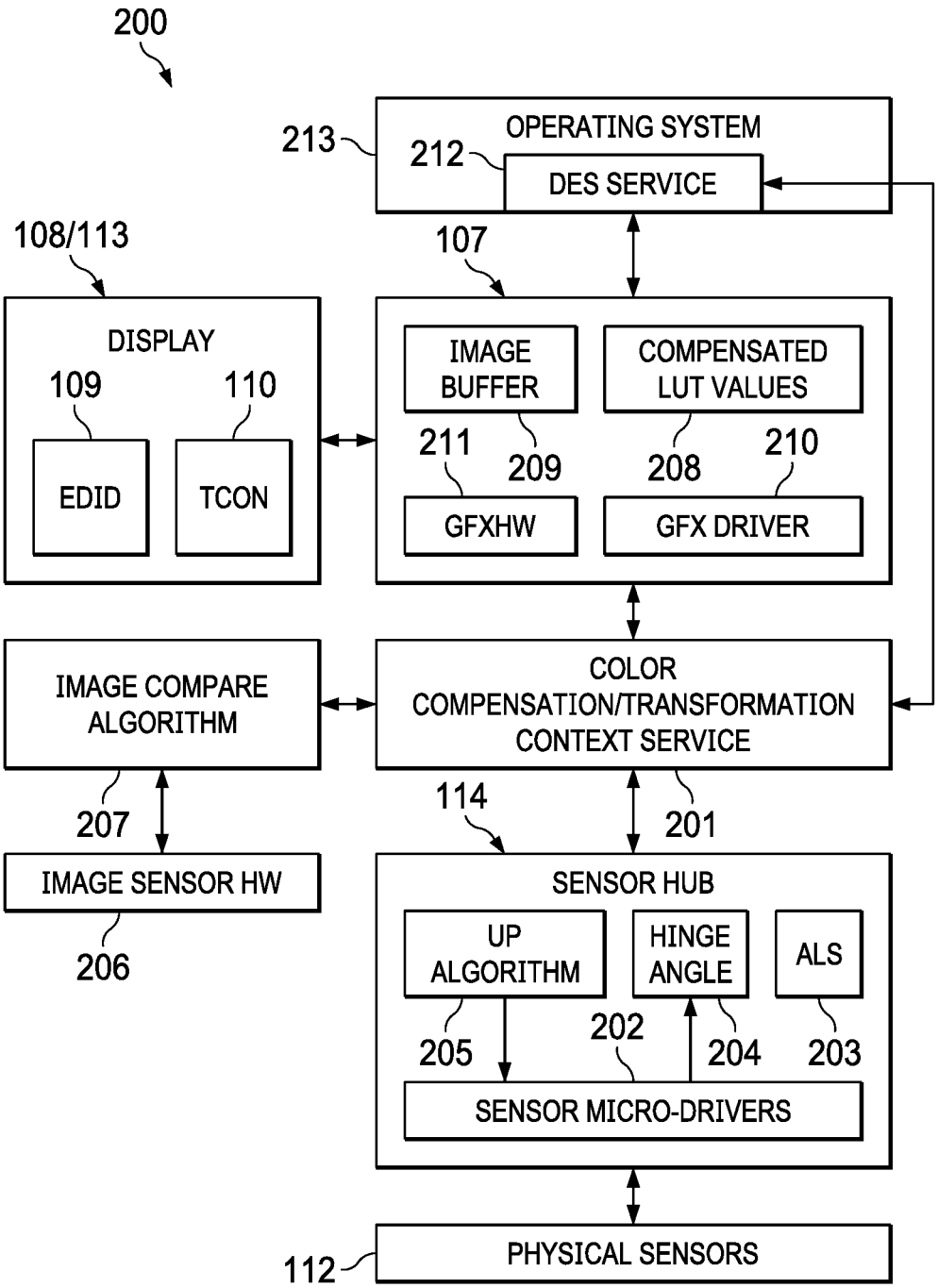
FIG. 2 is a diagram illustrating an example of a system configured to perform identification and correction of illumination sources, according to some embodiments.

FIG. 2 is a diagram illustrating an example of system 200 configured to perform identification and correction of illumination sources. In some cases, system 200 may be provided through the execution of program instructions stored in system memory 105 by processor 101 in cooperation with other hardware components of IHS 100, such as graphics processor 107, display(s) 108/113, sensor hub 114 (e.g., configured to perform sensor fusion operations), and sensors 112 (e.g., a CCD sensor and/or an ALS sensor).

Particularly, color compensation/transformation and context service 201 is executed by processor 101 and it is in communication with DES service 213 of OS 214. Service 201 is also in communication with sensor hub 114 and configured to receive information from physical sensors 112 after that information is received by corresponding sensor micro-drivers 202, such as ALS 203, hinge angle 204, user proximity (UP) algorithm 105, etc. Service 201 also receives images from CCD sensor 206 after processing by image processing/comparison algorithm 207, or the like.

Figure 5:
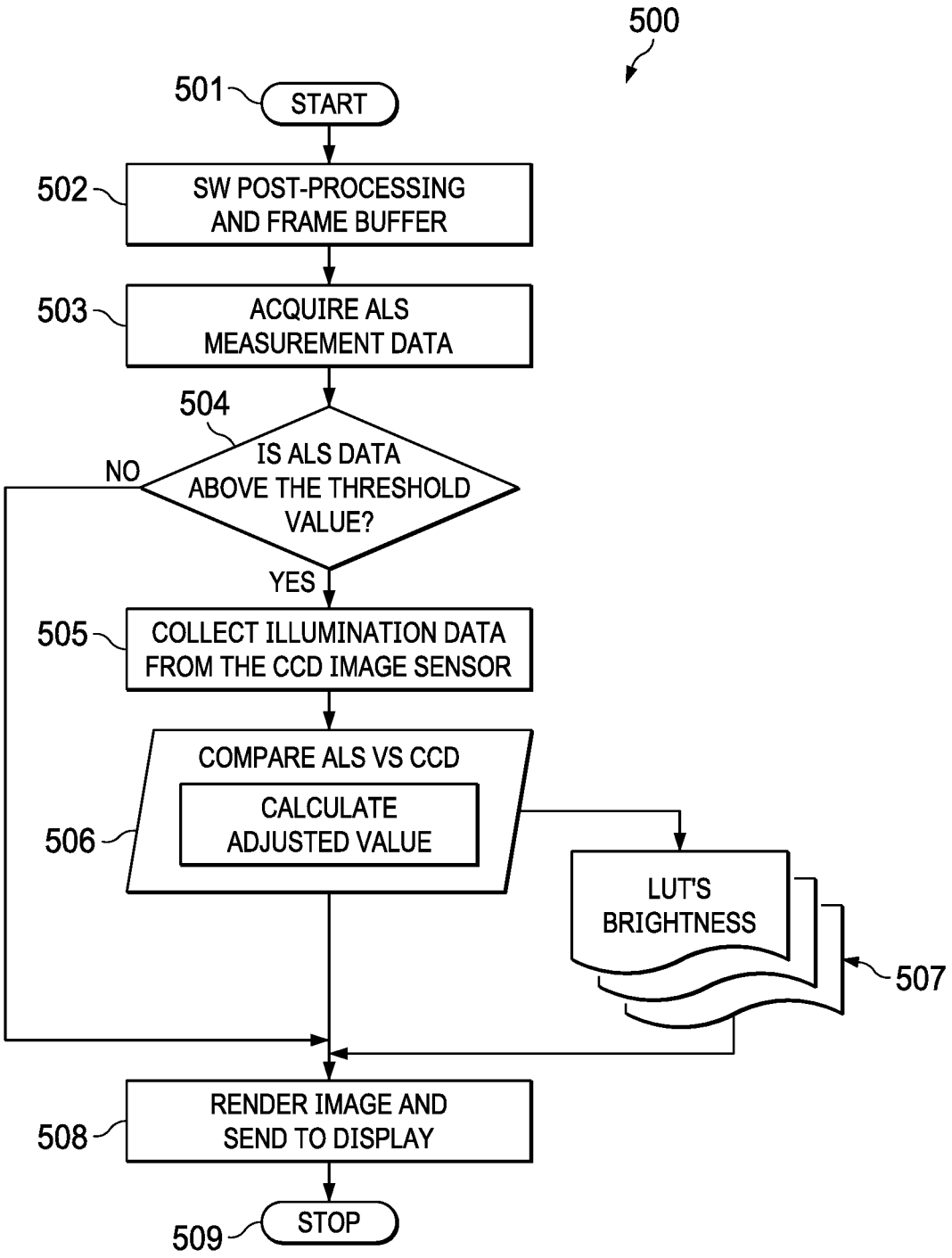
FIG. 5 is a flowchart illustrating an example of a method for adjusting Ambient Light Sensor (ALS) measurements, according to some embodiments.
Figure 6:
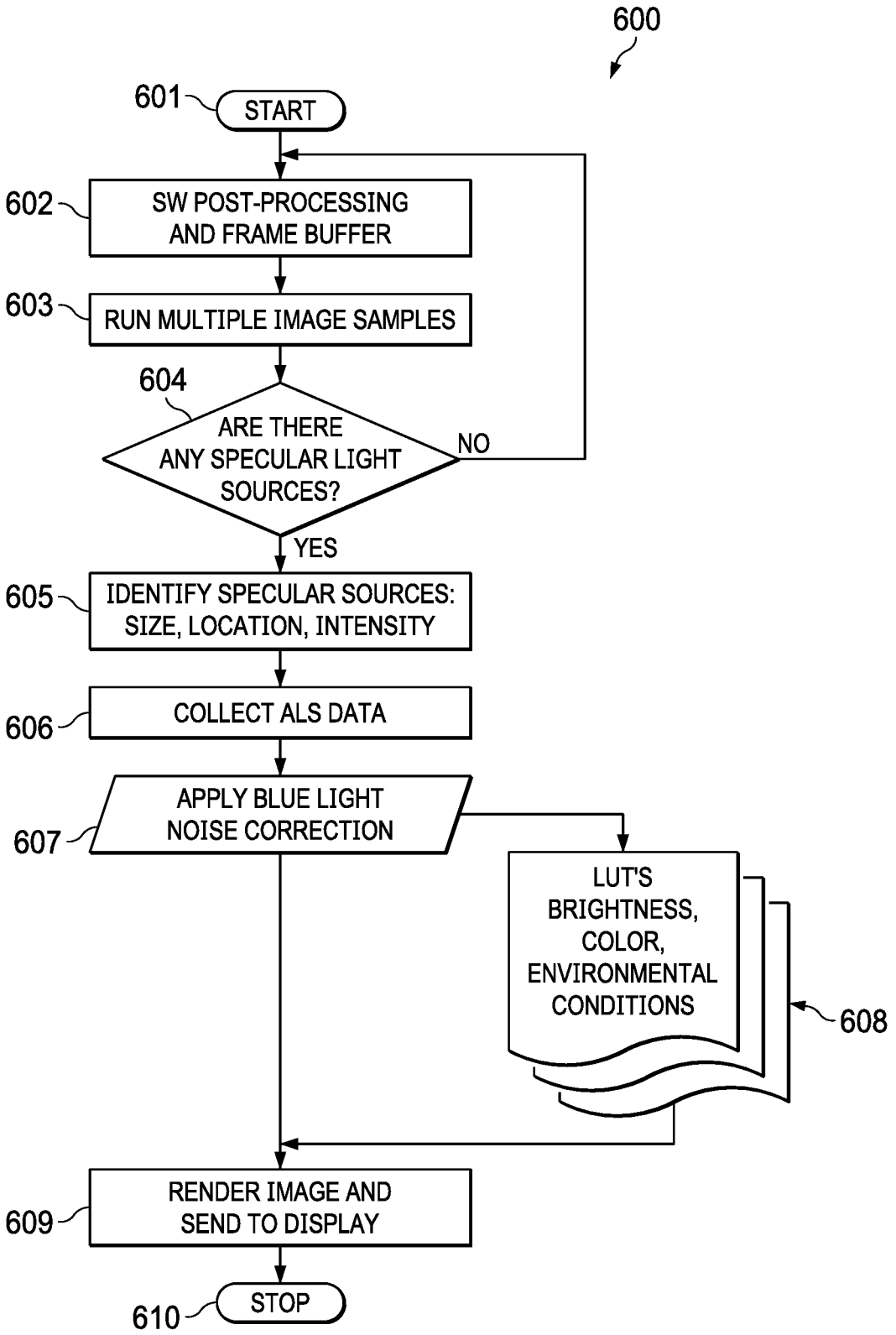
FIG. 6 is a flowchart illustrating an example of a method for identifying and correcting illumination sources, according to some embodiments.

Upon performing methods for identifying and correcting illumination sources, such as method 500 of FIG. 5 and/or method 600 of FIG. 6, service 201 modifies or compensates look-up table (LUT) values 208 maintained by graphics processor 107, and these modified values (e.g., adjusted brightness, color, etc.) are then applied to images stored in buffer 209. Display driver 210 interfaces with graphics hardware 211 to send adjusted or modified image data to timing controller (TCON) 212 of display 108 having Extended Display Identification Data (EDID) 213.

Figure 3:
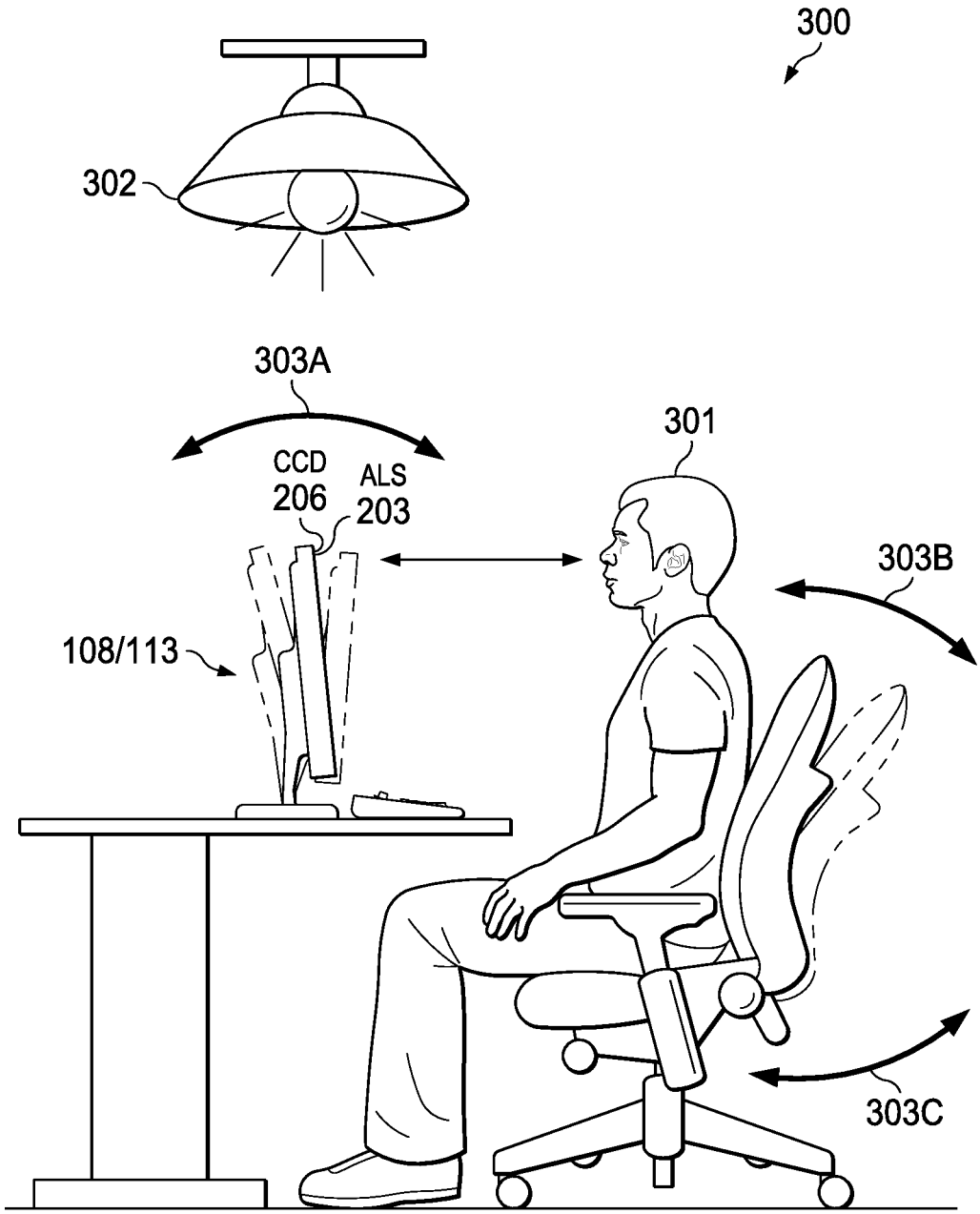
FIG. 3 is a diagram illustrating an example of an illumination source in an office environment, according to some embodiments.

FIG. 3 is a diagram illustrating an example of illumination source 302 in office environment 300. Particularly, user 301 is positioned before display 208/113 in the presence of light source 302 (e.g., a point source, a line source, etc.), which produces specular reflections. Because display 108/113 can move in direction 303A, and user 301 can move in at least directions 303B and 303C, the point or location of the specular reflection on the surface of display 108/113 is subject to change over time even when light source 302 is stationary with respect to environment 300. In this implementation, display 108/113 holds CCD 206 (e.g., a camera sensor) and ALS 203 (a photosensor with tristimulus XYZ color sensing). In other implementations, however, at least one of sensors 203 or 206 may be disposed on a keyboard or IHS chassis.

Figure 4:
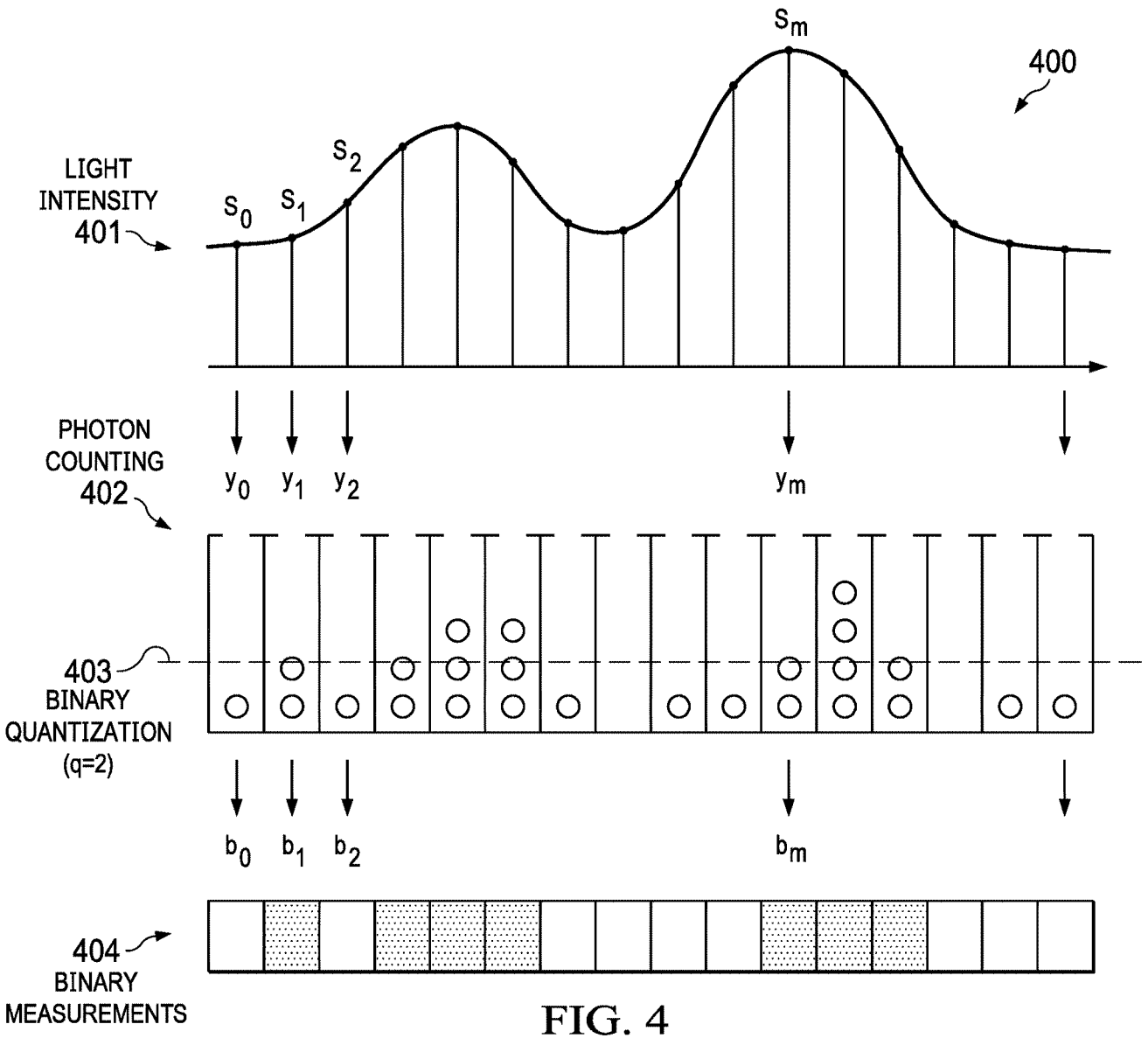
FIG. 4 is a diagram illustrating an example of a specular light source profile, according to some embodiments.

FIG. 4 is a diagram illustrating an example of specular light source profile 400. To build profile 400, service 201 of FIG. 2 may be configured to determine, based upon data received from ALS 203, light intensity curve 401 which, when subject to photon counting 402, yields binary quantization data 402 (q=2). Service 201 then uses binary quantization data 402 to produce binary measurements 404.

FIG. 5 is a flowchart illustrating an example of method 500 for adjusting ALS measurements. In some embodiments, method 500 may be performed, at least in part, by service 201 of FIG. 2 executed by processor 101 of FIG. 1. Particularly, method 500 may be used to improve ALS sensing accuracy by leveraging CCD sensing in response to an ALS brightness measurement is sensing a jump equal to or above a threshold value. If the CCD confirms that the ALS reading is from the light source, then that measurement value may be adjusted down, for example, using empirically determined adjustment values.

Method 500 begins at block 501. At block 502, method 500 receives image data from buffer 212 and performs any suitable post-processing operation(s). Then, at block 503, method 500 acquires ALS measurement data (e.g., Luminous Energy or "Qv," measured in lumen seconds (lms), Luminous Flux or "F," measured in Lumens (lm), Illuminance or "Ev," measured in Lux (lx), etc.). Block 504 determines whether the ALS measurement data is equal to or greater than selected threshold value(s). In some embodiments, these threshold value(s) may be selected based upon any combination of any of the aforementioned context information (e.g., an identity of a user or a user's proximity to the IHS, an identity of an application currently under execution or a duration of execution of the application, a user's gaze direction, a current IHS posture, an angle of a hinge, etc.).

If the ALS measurement data is below the threshold value(s), block 508 renders the image on display 108/113 and method 500 ends at block 509. Conversely, if block 504 determines that the ALS measurement data is equal to or greater than the threshold value(s), block 505 collects illumination data from CCD image sensor 208 (e.g., an image frame), block 506 compares the data between ALS sensor 205 and CCD sensor 208, and calculates adjusted value(s) for the original ALS measurement data. For example, block 506 may reduce the ALS measurement in a manner proportional to the difference between the illumination data from CCD image sensor 208 and the corresponding ALS measurement.

At block 507, method 500 may modify a brightness LUT usable to render images stored in image buffer 212 on display 108/113 using the adjusted ALS measurement. For example, the modified LUT may reduce the brightness of display 108/113. Then, block 508 renders the image on display 108/113 and method 500 ends at block 509.

FIG. 6 is a flowchart illustrating an example of method 600 for identifying and correcting illumination sources. In some embodiments, method 600 may be performed, at least in part, by service 201 of FIG. 2 executed by processor 101 of FIG. 1. Specifically, method 600 may be used regardless of whether ALS sensing is accurate, so long as there are specular reflecting sources in the image. In this case, the screen brightness can be adjusted as a value in between the corresponding ALS measurements and corresponding CCD measurements to mitigate the wide differences in brightness between the foreground and background (e.g., in a manner akin to identifying a proper "f-stop" for the image brightness level).

Method 600 begins at block 601. At block 602, method 600 receives image data from buffer 212 and performs any suitable post-processing operation(s). At block 603, method 300 collets and analyzes multiple image samples. Block 604 determines, based upon the analysis of block 603, whether there are any specular light sources (e.g., source 302) in the acquired images. Block 605 identifies characteristics of the specular light sources such as location, size, shape, intensity, etc. Then, block 606 collects ALS measurement data.

At block 607, method 600 may apply a correction to the images stored in frame buffer 212 (e.g., blue light noise correction, etc.). Particularly, block 607 may calculate color, brightness, and/or other corrections to compensate for the specular light source, and it may apply those corrections to corresponding LUTs at block 608. Finally, block 609 renders the corrected images on display 108/113, and method 600 ends at block 610.

It should be understood that various operations described herein may be implemented in software executed by processing circuitry, hardware, or a combination thereof. The order in which each operation of a given method is performed may be changed, and various operations may be added, reordered, combined, omitted, modified, etc. It is intended that the invention(s) described herein embrace all such modifications and changes and, accordingly, the above description should be regarded in an illustrative rather than a restrictive sense.

The terms "tangible" and "non-transitory," as used herein, are intended to describe a computer-readable storage medium (or "memory") excluding propagating electromagnetic signals; but are not intended to otherwise limit the type of physical computer-readable storage device that is encompassed by the phrase computer-readable medium or memory. For instance, the terms "non-transitory computer readable medium" or "tangible memory" are intended to encompass types of storage devices that do not necessarily store information permanently, including, for example, RAM. Program instructions and data stored on a tangible computer-accessible storage medium in non-transitory form may afterwards be transmitted by transmission media or signals such as electrical, electromagnetic, or digital signals, which may be conveyed via a communication medium such as a network and/or a wireless link.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. An Information Handling System (IHS), comprising:

a processor; and a memory coupled to the processor, the memory having program instructions stored thereon that, upon execution, cause the IHS to:

receive a measurement from an Ambient Light Sensor (ALS);

determine that the measurement indicates an increase in ambient illumination equal to or greater than a threshold value;

in response to the determination, receive an image from a charge-coupled device (CCD) sensor;

extract illumination data from the image;

reduce the measurement in proportion to the difference between the illumination data and the measurement to produce an adjusted value; and adjust the measurement by the adjusted value.

2. The IHS of claim 1, wherein to adjust the measurement, the program instructions, upon execution, further cause the IHS to reduce the measurement using a look-up table (LUT).

3. The IHS of claim 1, wherein the program instructions, upon execution by the processor, cause the IHS to modify a brightness of a display coupled to the IHS based upon the adjusted measurement, wherein the display comprises an Organic Light-Emitting Diode (OLED) panel.

4. The IHS of claim 1, wherein the program instructions, upon execution, further cause the IHS to identify a light source in the image.

5. The IHS of claim 4, wherein to identify the light source, the program instructions, upon execution, further cause the IHS to determine a location, intensity, and shape of the light source.

6. The IHS of claim 5, wherein the program instructions, upon execution, further cause the IHS to apply a blue light noise correction to the image based upon the identification of the light source prior to rendering the image on the display.

7. The IHS of claim 1, wherein prior to receiving the measurement, the program instructions, upon execution, further cause the IHS to classify a location of the IHS as matching that of an office environment, and wherein the measurement is received in response to the classification.

8. The IHS of claim 1, wherein the threshold value is selected based upon at least one of an identity of a user or a user's proximity to the IHS.

9. The IHS of claim 1, wherein the threshold value is selected based upon at least one of: an identity of an application currently under execution or a duration of execution of the application.

10. The IHS of claim 1, wherein the threshold value is selected based upon a user's gaze direction.

11. The IHS of claim 1, wherein the threshold value is selected based upon a current IHS posture.

12. The IHS of claim 11, wherein the current IHS posture is determined by an angle of a hinge coupling two portions of the IHS.

13. A non-transitory memory storage device having program instructions stored thereon that, upon execution by one or more processors of an Information Handling System (IHS), cause the IHS to:

receive a measurement from an Ambient Light Sensor (ALS);

determine that the measurement indicates an increase in ambient illumination equal to or greater than a threshold value, wherein the threshold value is selected based upon the identity of the user;

in response to the determination, receive an image from a charge-coupled device (CCD) sensor;

identify a light source in the image, the identification comprising a location, an intensity, and a shape of the light source;

apply a blue light noise correction to the image based upon the identification of the light source prior to rendering the image on a display coupled to the IHS;

extract illumination data from the image;

reduce the measurement in proportion to the difference between the illumination data and the measurement to produce an adjusted measurement; and modify a brightness of the display based upon the adjusted measurement.

14. The memory storage device of claim 13, wherein the threshold value is selected also based upon at least one of: a user's proximity to the IHS or a user's gaze direction.

15. The memory storage device of claim 13, wherein the threshold value is selected also based upon a current IHS posture.

16. A method, comprising:

receiving a measurement from an Ambient Light Sensor (ALS);

determining that the measurement indicates an increase in ambient illumination equal to or greater than a threshold value, wherein the threshold value is selected based upon at least one of: an identity of an application currently under execution or a duration of execution of the application;

in response to the determination, receiving an image from a charge-coupled device (CCD) sensor;

extracting illumination data from the image;

adjusting the measurement in response to the illumination data by reducing the measurement in proportion to the difference between the illumination data and the measurement;

identifying a light source in the image, the identification comprising a location, an intensity, and a shape of the light source;

applying a blue light noise correction to the image based upon the identification of the light source prior to rendering the image on the display; and modifying a brightness of a display coupled to an Information Handling System (IHS) based upon the adjusted measurement.

17. The method of claim 16, wherein the threshold value is selected also based upon at least one of: an identity of a user, a user's proximity to the IHS, or a user's gaze direction.

18. The method of claim 16, wherein the threshold value is selected also based upon a current IHS posture.

* * * * *